US006333495B1

(12) United States Patent
Park

(10) Patent No.: US 6,333,495 B1
(45) Date of Patent: Dec. 25, 2001

(54) SAFETY DEVICE FOR A MICROWAVE OVEN

(75) Inventor: Myoung-hwan Park, Suwon (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/482,061

(22) Filed: Jan. 13, 2000

(30) Foreign Application Priority Data

Jan. 14, 1999 (KR) ..... 99-760
Jan. 14, 1999 (KR) ..... 99-761

(51) Int. Cl.[7] ..... H05B 6/68
(52) U.S. Cl. ..... 219/722; 219/724; 200/50.12
(58) Field of Search ..... 219/722, 723, 219/724, 716; 126/197, 192; 200/50.12, 50.13, 50.16

(56) References Cited

U.S. PATENT DOCUMENTS 3,865,097 * 2/1975 Robinson ..... 126/197
4,982,063 * 1/1991 Tsunekawa et al. ..... 219/722

FOREIGN PATENT DOCUMENTS 2143410A 2/1985 (GB) .
2172180A 9/1986 (GB) .
60-245936 * 12/1985 (JP) ..... 219/724
60-263036 12/1985 (JP) .
61-268924 * 11/1986 (JP) ..... 219/724
63-21422 1/1988 (JP) .
64-70618 3/1989 (JP) .
5-26451 * 2/1993 (JP) ..... 219/724
5-66018 * 3/1993 (JP) ..... 219/724
6-272871 * 9/1994 (JP) ..... 219/722

OTHER PUBLICATIONS

German Patent Office Action, dated May 2, 2001 (English translation is attached.).

* cited by examiner

*Primary Examiner*—Philip H. Leung
(74) *Attorney, Agent, or Firm*—Robert E. Bushnell, Esq.

(57) ABSTRACT

A safety device for a microwave oven capable of improving the assembly of the microwave oven by reducing a length of a door latch and thus securing more spacious assembly space for other parts of microwave oven. The safety device for the microwave oven includes a door key movably mounted on a door of the microwave oven and having a key switch portion protruding toward the front side of the cabinet; and a plurality of switches to be turned on/off in accordance with the reception/withdrawal of the key switch portion to selectively connect a power supply with a driving circuit, and one of the plurality of switches that is arranged in the innermost position of the device chamber is operated directly by the key switch portion.

17 Claims, 7 Drawing Sheets

SAFETY DEVICE FOR A MICROWAVE OVEN

CLAIM OF PRIORITY

This application makes reference to, incorporates the same herein, and claims all benefits accruing under 35 U.S.C. §119 from applications for DOOR INTERLOCK APPARATUS OF A MICROWAVE OVEN earlier filed in the Korean Industrial Property Office on the 14th of January 1999 and there duly assigned Ser. No. 760/1999, and for DOOR INTERLOCK APPARATUS OF A MICROWAVE Oven earlier filed in the Korean Industrial Property Office on the 14th of January 1999 and there duly assigned Ser. No. 761/1999.

BACKGROUND OF THE INVENTION

1. Field of the Invention

The present invention relates to a microwave oven, and more particularly to a safety device for a microwave oven which is operated in accordance with the opening/closing status of a door of the microwave oven to selectively connect a power supply with a driving circuit.

2. Description of the Prior Art

Generally, a microwave oven is a device for cooking/warming food by using microwaves, and has the advantage that it cooks various kinds of foods within a short period of time while keeping the original texture of the foods.

A conventional microwave oven is shown in FIG. 1. Referring to FIG. 1, the conventional microwave oven has a cabinet 10 which is divided into a cooking chamber 10*a* and a device chamber 10*b*. The cooking chamber 10*a* receives the food to be cooked therein, and a door 30 is mounted on the front side of the cooking chamber 10*a*. Various electric components 22*a*, 22*b*, 22*c*, 22*d* are arranged in the device chamber 10*b* for generating the microwaves for cooking the desired food, and a control panel 40 is formed on the front side of the device chamber 10*b*.

However, there is the possibility that the microwave oven can be operated without the door 30 being completely closed, and the microwaves radiated into the cooking chamber 10*a* may leak outside, harming the user. In order to prevent such a dangerous use, a safety device is essentially required for the microwave oven to selectively control the operation of the microwave oven by detecting the opening/closing status of the door 30. FIG. 2A shows the safety device of a conventional microwave oven.

Referring to FIG. 2A, the safety device of the subject conventional microwave oven includes a first switch 41, a second switch 42, and a third switch 43, all of which are formed on a door latch 12 of the device chamber 10*b*, and a door key 37 having a pair of key switch portions 37*a* and 37*b* formed on the door 30 for operating the contact points of the first, second, and third switches 41,42, and 43.

The first switch 41 is arranged near the end of a first guide portion 13*a*, and the second and third switches 42 and 43 are arranged near the end of a second guide portion 13*b*. Between the second guide portion 13*b* and the third switch 43, a switch lever 44 is disposed such that it is pivoted on a hinge axis 44*a*. The first, second, and third switches 41, 42, and 43 selectively connect a power supply (not shown) with a driving circuit (not shown) of the microwave oven.

As the user closes the door 30, the pair of key switch portions 37*a* and 37*b* of the door key 37 are inserted into a pair of insert holes 12*a* and 12*b* of the door latch 12, and are guided along the guide portions 13*a* and 13*b*, respectively.

Accordingly, by the second key switch portion 37*b*, the switch lever 44 is pivoted, and the contact point of the third switch 43 is operated. When the door 30 is completely closed, as shown in FIG. 2B, the pair of key switch portions 37*a* and 37*b* are moved downward by a spring 37*c*, so that the contact points of the first and second switches 41 and 42 are operated. Only when the contact points of the first, second, and third switches 41, 42, and 43 are operated, the power supply (not shown) is connected to the driving circuit (not shown).

In the event that the door 30 is incompletely closed and any contact point of the first, second, and third switches 41, 42, and 43 is not in operation, the power supply (not shown) can not make contact with the driving circuit (not shown), and as a result, the microwave oven can not be turned on.

According to the safety device of the subject conventional microwave oven, however, the third switch 43, which is located in the innermost part of the device chamber 10*b*, is positioned to be operated indirectly via the switch lever 44. Therefore, a space for the switch lever 44 between the second key switch portion 37*b* and the third switch 43 is needed, and the length L of the door latch 12 is lengthened.

As the length L of the door latch 14 is lengthened, the total available space in the device chamber 10*b* is relatively reduced, and the space for the various operational components 22*a*, 22*b*, 22*c*, and 22*d* is reduced. Accordingly, the efficient assembly of the microwave oven is deteriorated.

Further, according to the safety device of the conventional microwave oven, as shown in FIGS. 2A and 2B, wiring pins 41*a* and 42*a* of the first and second switches 41 and 42 are extended inward in the device chamber 10*b*, while the wiring pin 43*a* of the third switch 43 is extended toward the door 30. Accordingly, the wiring structure becomes complex, and the assembly of the microwave oven is deteriorated due to the complex wiring process.

SUMMARY OF THE INVENTION

The present invention has been developed to overcome the above-mentioned problems of the referenced prior art, and accordingly, it is a first object of the present invention to provide a safety device for a microwave oven capable of improving the assembly of the microwave oven by reducing the space needed for a door latch and thus securing more assembly space for other component parts.

A second object of the present invention is to provide a safety device for a microwave oven which simplifies the wiring process and structure of switches, by extending the wiring pins of the switches in substantially the same direction.

The first object is accomplished by a safety device for a microwave oven including a door, a cabinet having a cooking chamber and a device chamber, a power supply, and a driving circuit according to the present invention, comprising: a door key movably mounted on the door of the microwave oven and having a key switch portion protruding toward the front side of the cabinet; and a plurality of switches turned on/off in accordance with drawing/withdrawing of the key switch portion, to selectively connect the power supply with the driving circuit, in which one of the plurality of switches, that is arranged in the innermost position of the device chamber, is operated directly by the key switch portion.

Further, the second object is accomplished by a safety deice for a microwave oven including a door, a cabinet having a cooking chamber and a device chamber, a power supply, and a driving circuit according to the present invention, comprising: a door key movably mounted on the door of the microwave oven and having a key switch portion protruding toward the front side of the cabinet; and a plurality of switches to be turned on/off in accordance with the drawing/withdrawing of the key switch portion to selectively connect the power supply with the driving circuit, in which wiring pins of the plurality of switches are extended either in a direction of the vertical line of the door key, or inward the device chamber from the vertical line of the door key.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
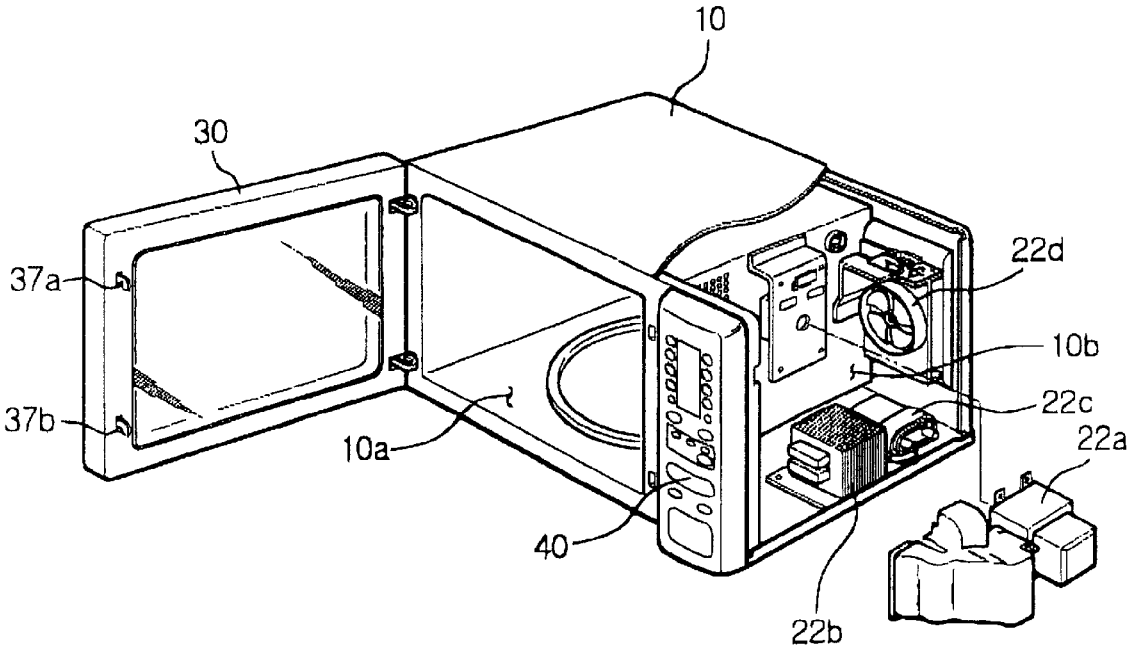
FIG. 1 (PRIOR ART)
FIG. 1 is a partially cutaway perspective view of a conventional microwave oven.
Figure 2A:
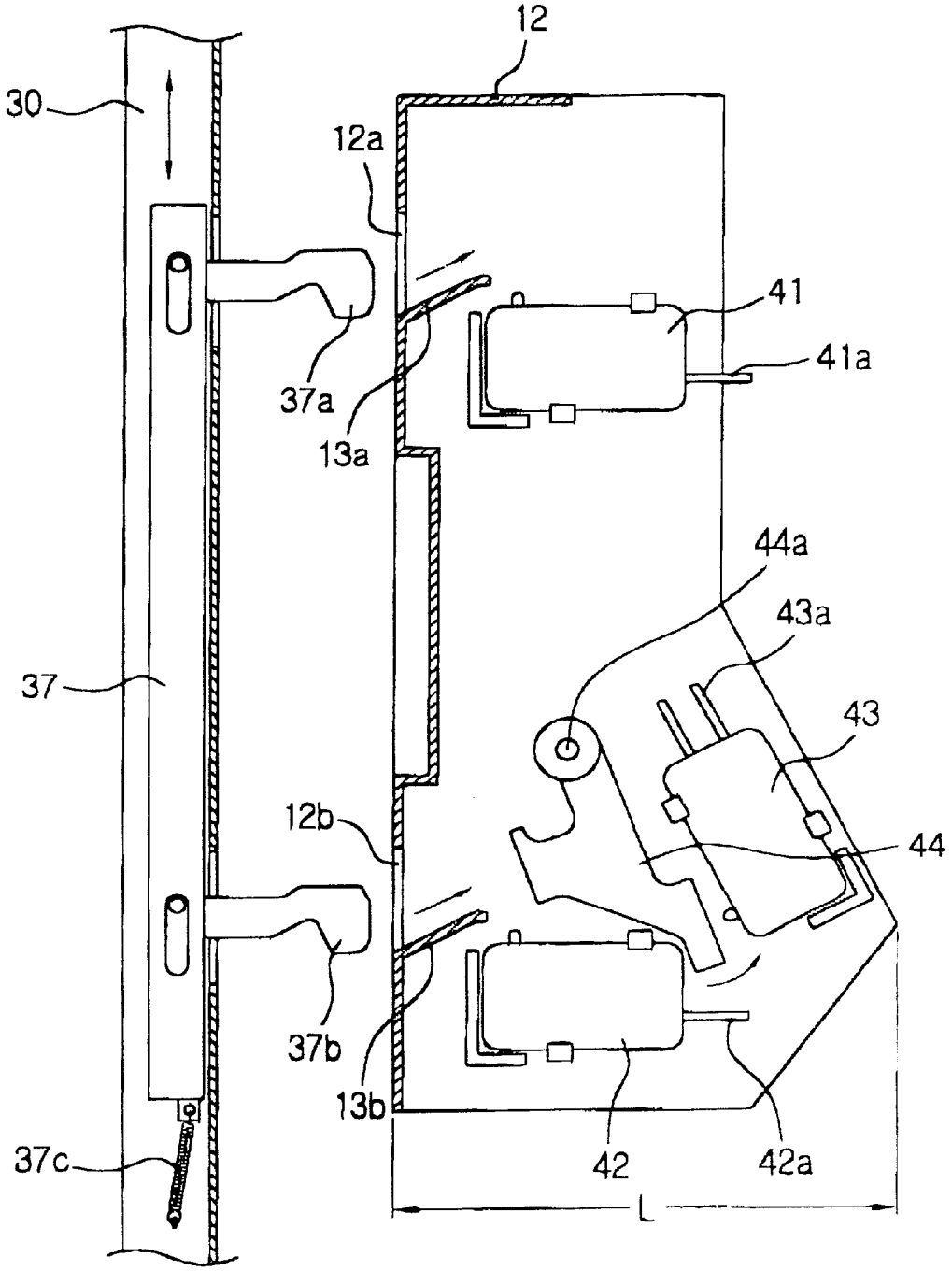
FIG.2A (PRIOR ART)
FIG. 2A is a sectional view for showing the main portion of a safety device of a conventional microwave oven, in which a door of a microwave oven is in an open state.
Figure 2B:
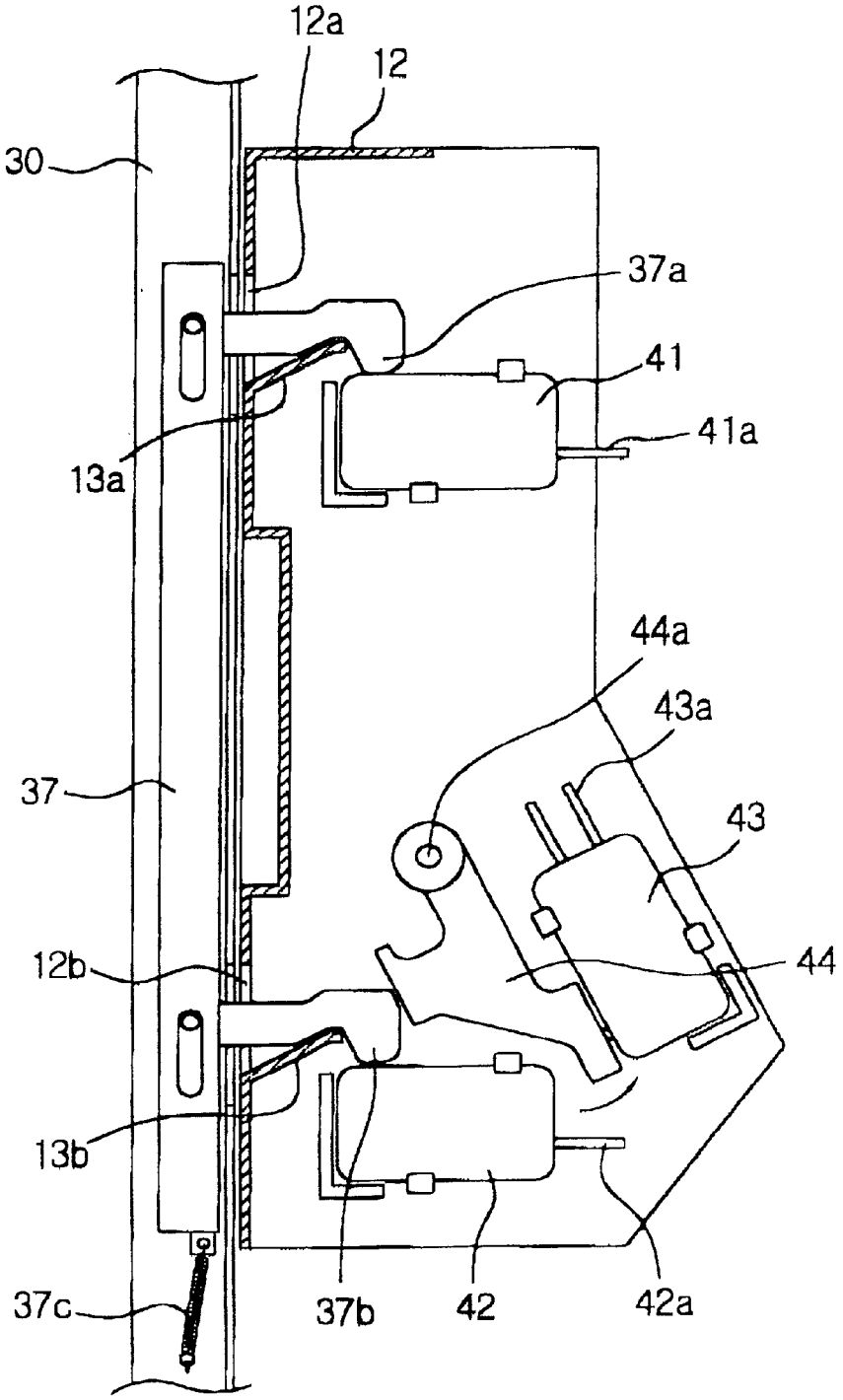
FIG.2B (PRIOR ART)
FIG. 2B is a sectional view for showing the main portion of the safety device of the conventional microwave oven in which the door of a microwave oven is in a closed state.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 3A:
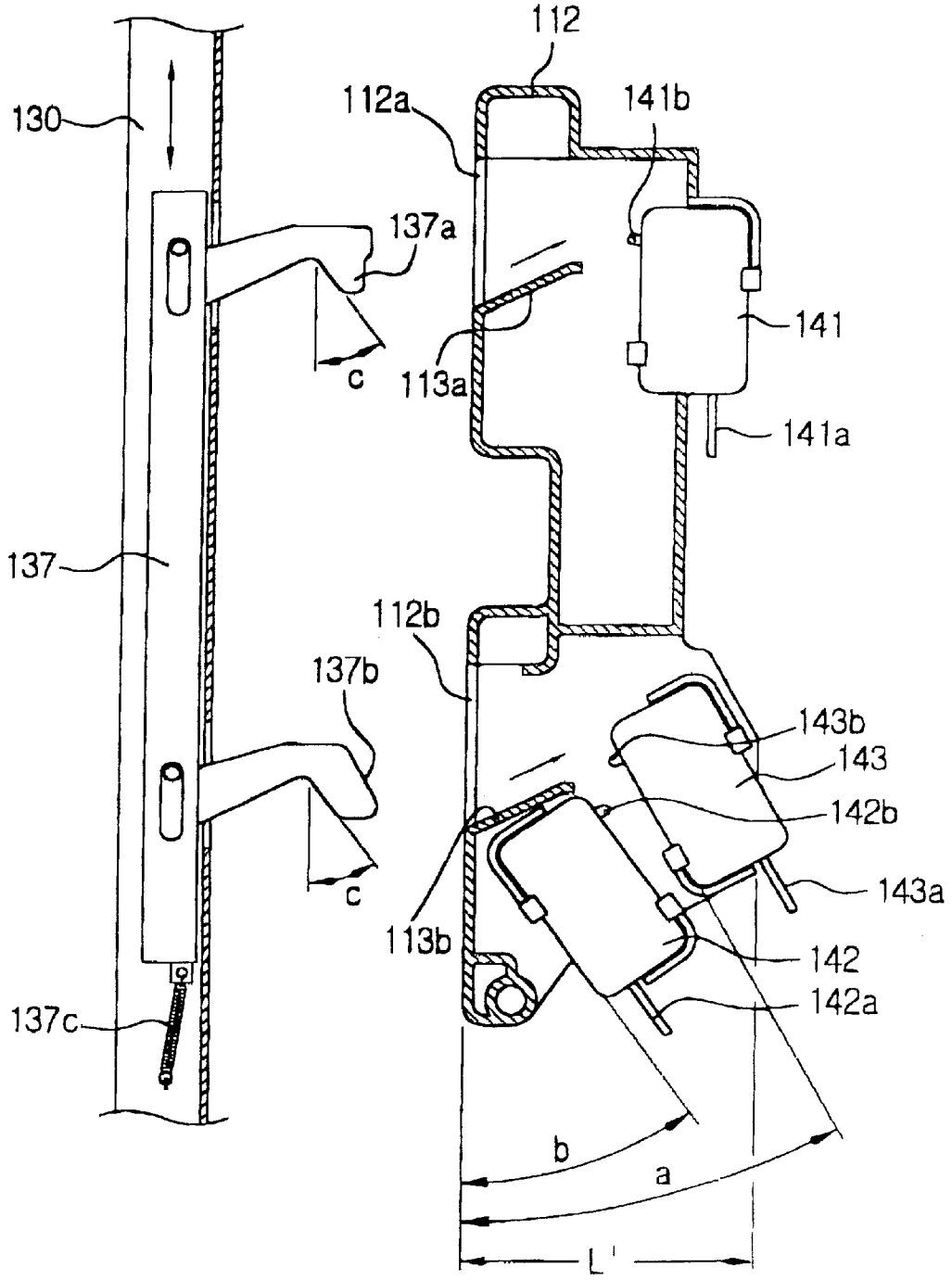
FIG. 3A is a sectional view for showing the main portion of a safety device according to a first preferred embodiment of the present invention, in which a door of a microwave oven is in an open state.
Figure 3B:
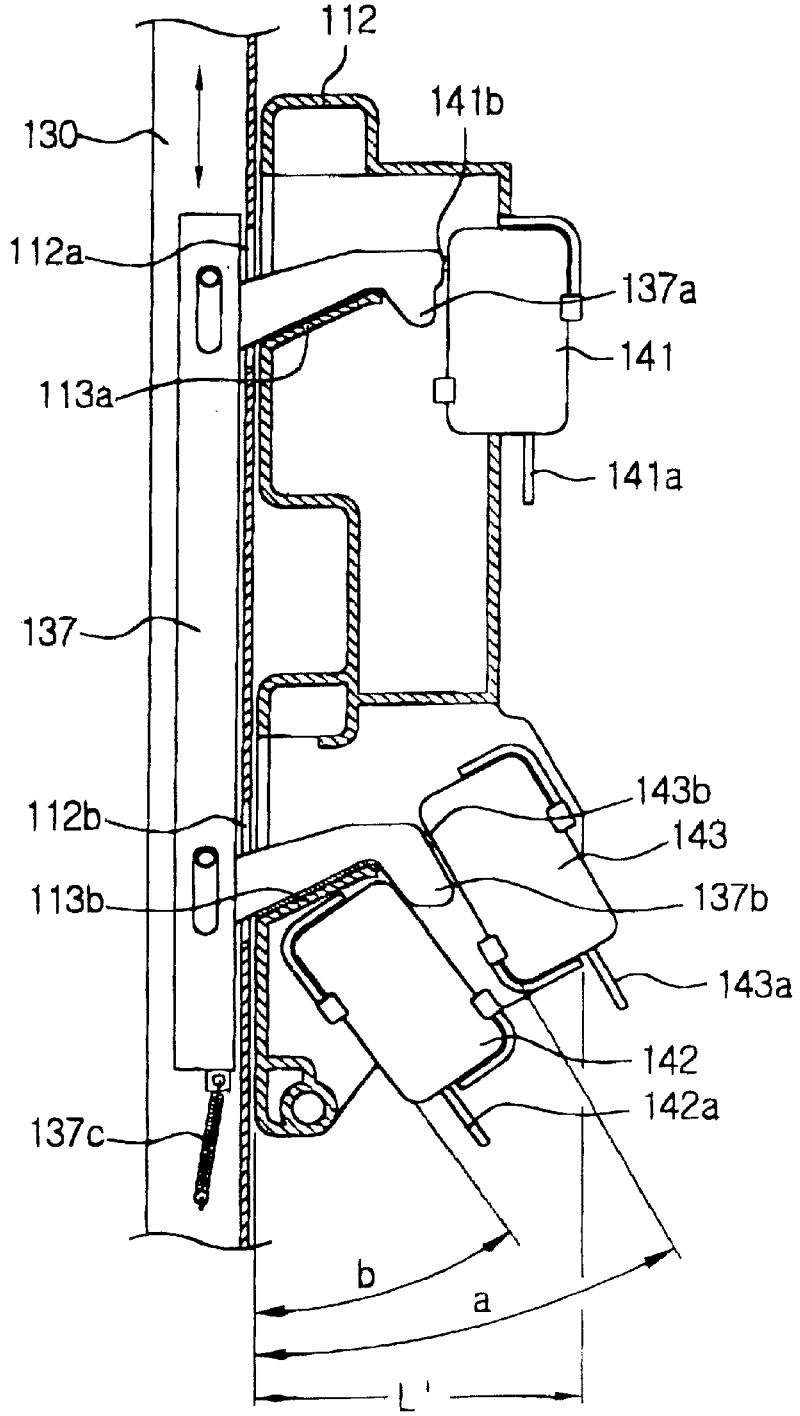
FIG. 3B is a sectional view for showing the main portion of the safety device according to the first preferred embodiment of the present invention, in which the door of the microwave oven is in a closed state.

FIGS. 3A and 3B show a safety device of a microwave oven according to a first preferred embodiment of the present invention.

Referring to FIGS. 3A and 3B, the safety device of the microwave oven according to the first preferred embodiment of the present invention includes a door key 137, and first, second, and third switches 141, 142, and 143.

The door key 137 is biased downward by a spring 137*c*, and is movably mounted on a door 130 of the microwave oven. The door key 137 has first and second switch portions 137*a* and 137*b* which are protruded toward the front side of the cabinet 10 of the microwave oven.

The first, second, and third switches 141, 142, and 143 are formed on a door latch 112, which is arranged in the device chamber 10*b* of the microwave oven, and are turned on/off by the first and second key switch portions 137*a* and 137*b*, to selectively connect the power supply (not shown) of the microwave oven with a driving circuit (not shown).

On the door latch 112, insert holes 112*a* and 112*b* are formed to permit the drawing/withdrawing of the key switch portions 137*a* and 137*b* therethrough, and first and second guide portions 113*a* and 113*b* are also formed on the door latch 112 to guide the movement of the first and second key switch portions 137*a* and 137*b*.

The first switch 141 is arranged near the end of the first guide portion 113*a*, while the second and third switches 142 and 143 are arranged near the end of the second guide portion 113*b*.

In such a situation, the second switch 142 which is positioned at the lowest portion of the door latch 112, and the third switch 143 which is positioned in the innermost portion of the device chamber 10*b*, are arranged to face each other by having a space therebetween. Here, the space between the second and third switches 142 and 143 is determined such that the second and third operational portions 142*b* and 143*b* of the second and third switches 142 and 143 are simultaneously pushed by the second switch portion 137*b*.

Meanwhile, it is preferable that the key switch portions 137*a* and 137*b* be slanted at a certain angle with respect to the vertical line of the door key 137 to smoothly operate the door key 137. Accordingly, the second and third switches 142 and 143 are slanted at the same angle as the first and second key switch portions 137*a* and 137*b*.

Further, it is preferable that the space defined between the second and third switches 142 and 143 is formed such that the upper space is larger than the lower space.

More specifically, the slanted angle "c" for the first and second key switch portions 137*a* and 137*b* with respect to the vertical line of the door key 137, is set at a range of approximately from 25° to 35° with the most preferable value of 30°. Further, the slanted angle "b" for the second switch 142 with respect to the vertical line of the door key 137, is set at a range of approximately from 33° to 39°, with the most preferable value of 36°, and the slanted angle "a" for the third switch 143 with respect to the vertical line of the door key 137, is set at a range of approximately from 27° to 33°, with the most preferable value of 30°.

It is further preferable that the wiring pins 141*a*, 142*a*, 143*a* of the first, second, and third switches 141, 142, and 143 are either extended along the vertical line of the door key 137, or extended inward the device chamber 10*b* from the vertical line of the door key 137.

The safety device of the microwave oven according to the first preferred embodiment of the present invention constructed as above is operated as follows:

As the door 130 is closed, the pair of key switch portions 137*a* and 137*b* extended from the door key 137 are inserted into the insert holes 112*a* and 112*b* of the door latch 112, and are guided along the first and second guide portions 113*a* and 113*b*.

As the door is completely closed, the first key switch portion 137*a* pushes the first operational portion 141*b* of the first switch 141, while the second key switch portion 137*b* is inserted between the second and third switches 142 and 143.

Accordingly, operational portions 142*b* and 143*b* of the second and third switches 142 and 143 are pushed simultaneously by the second key switch portion 137*b*, so that the power supply and the driving circuit of the microwave oven make contact with each other, and then the user can use the microwave oven.

In the event that the door 130 is incompletely closed and any operational portion of the first, second, and third switches 141, 142, and 143 is not pushed, the power supply can not make contact with the driving circuit, so that the microwave oven is inoperable.

Figure 4A:
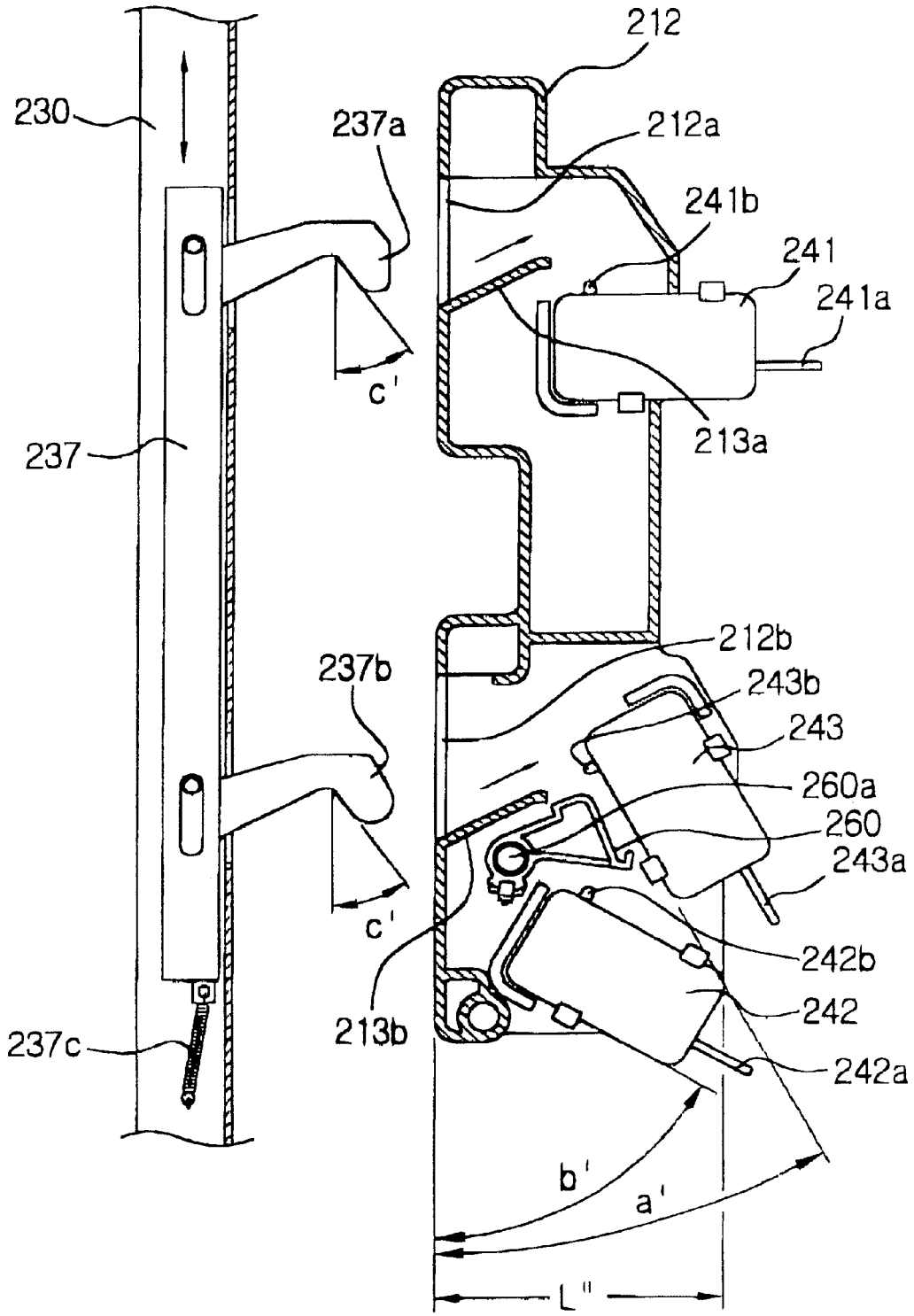
FIG. 4A is a sectional view for showing the main portion of a safety device according to a second preferred embodiment of the present invention, in which a door of a microwave oven is in is an open state.
Figure 4B:
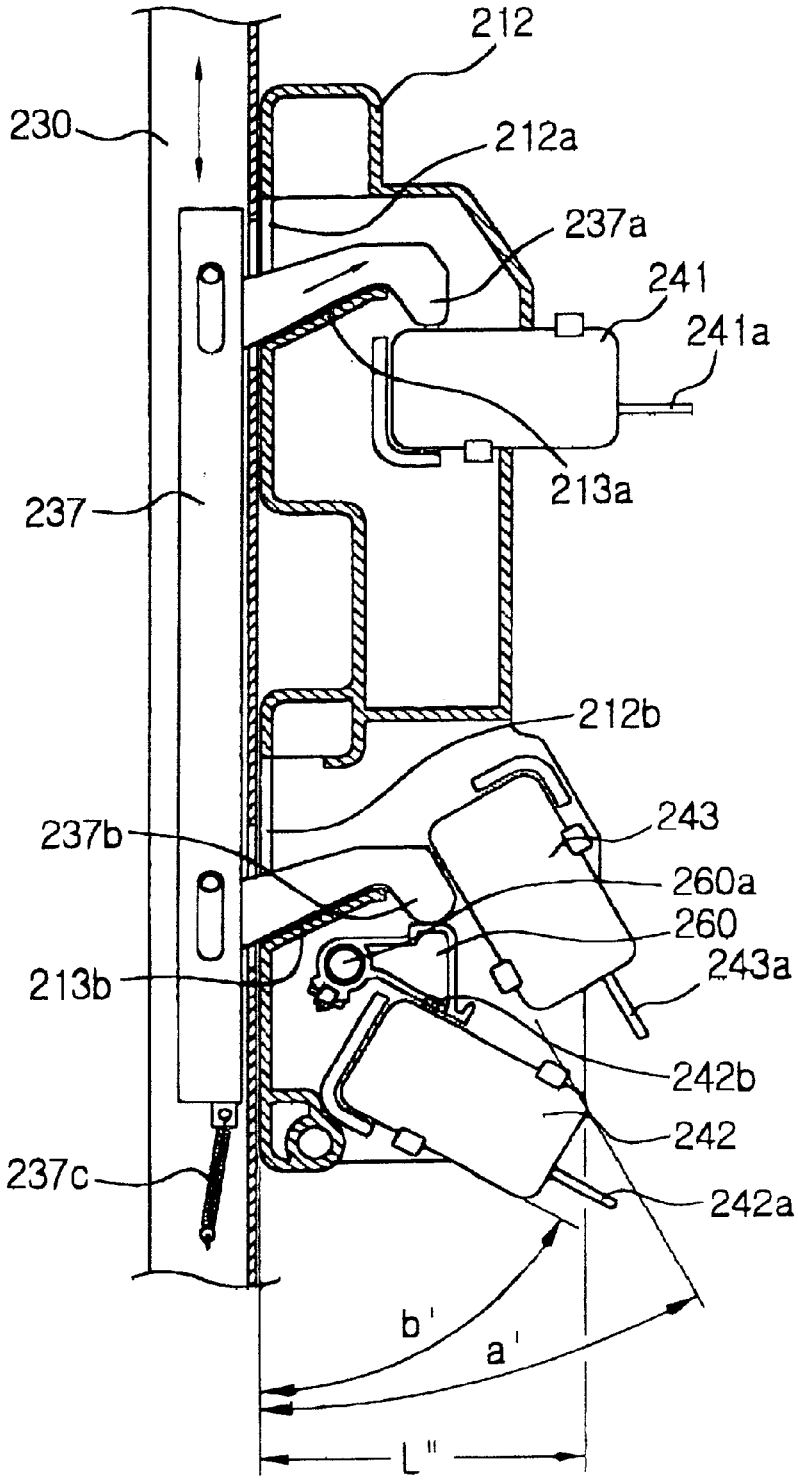
FIG. 4B is a sectional view for showing the main portion of the safety device according to the second preferred embodiment of the present invention, in which the door of the microwave oven is in a closed state.

Further, FIGS. 4A and 4B show the safety device for a microwave oven according to the second preferred embodiment of the present invention.

Referring to FIGS. 4A and 4B, the safety device for the microwave oven according to the second preferred embodiment of the present invention includes a door key 237, a switch lever 260, and first, second, and third switches 241, 242, and 243.

The door key 237 is biased downward by a spring 237*c*, and is movably mounted on a door 230 of the microwave oven. Further, the door key 237 has first and second key switch portions 237*a* and 237*b* protruded toward the front side of the cabinet 10 of the microwave oven.

The first, second, and third switches 241,242, and 243 are formed on a door latch 212 which is positioned in the device chamber 10*b* of the microwave oven, and are turned on/off by the first and second key switch portions 237*a* and 237*b*, to selectively connect a power supply (not shown) with a driving circuit (not shown).

On the door latch 212, insert holes 212*a* and 212*b* are formed to permit the drawing/withdrawing of the key switch portions 237*a* and 237*b* therethrough, and further, first and second guide portions 213*a* and 213*b* are formed on the door latch 212 to guide the movement of the key switch portions 237*a* and 237*b*, respectively.

The first switch 241 is arranged near the end of the first guide portion 213*a*, while the second and third switches 242 and 243 are arranged near the end of the second guide portion 213*b*. Between the second and third switches 242 and 243, a switch lever 260 is disposed such that it is pivoted on a hinge axis 260*a*.

Here, the second switch 242 which is arranged at the lowest portion of the door latch 212, and the third switch 243 which is arranged in the innermost position of the device chamber 10*b*, are spaced from each other at a certain distance that the third operational portion 243*b* of the third switch 243 is pushed directly by the second key switch 237*b* while the second operational portion 242*b* of the second switch 242 is pushed indirectly by the second key switch 237*b* via the switch lever 260, when the second key switch portion 237*b* is inserted between the second and third switches 242 and 243.

Further, for the smoother operation of the door key 237, it is preferable that the first and second key switch portions 237*a* and 237*b* are slanted at a certain angle with respect to the vertical line of the door key 237, and it is accordingly preferable that the second and third switches 242 and 243 are slanted at the same angle as the first and second key switch portions 237*a* and 237*b* are.

More specifically, it is preferable that the slanted angle "c" for the first and second key switch portions 237*a* and 237*b* with respect to the vertical line of the door key 237, is set at a range of approximately from 32° to 42° with the most preferable value of 37°. Further, the slanted angle "b" for the second switch 242 with respect to the vertical line of the door key 237, is set at a range of approximately from 55° to 65°, with the most preferable value of 60°, and the slanted angle "a" for the third switch 243 with respect to the vertical line of the door key 237, is set at a range of approximately from 25° to 35°, with the most preferable value of 30°.

It is further preferable that the wiring pins 241*a*, 242*a*, and 243*a* of the first, second, and third switches 241, 242, and 243 are either extended along the vertical line of the door key 237, or extended inward the device chamber 10*b* from the vertical line of the door key 237.

The safety device for the microwave oven constructed as above according to the second preferred embodiment of the present invention is operated as follows:

As the door 230 is closed, the first and second key switch portions 237*a* and 237*b* extended from the door key 237 are inserted into the insert holes 212*a* and 212*b* of the door latch 212, and are guided along the first and second guide portions 213*a* and 213*b*, respectively.

As the door 230 is completely closed, the first key switch portion 237*a* pushes the first operational portion 241*b* of the first switch 241, while the second switch portion 237*b* is inserted between the second and third switches 242 and 243.

Accordingly, a third operational portion 243*b* of the third switch 243 is pushed directly by the second key switch portion 237*b*, while the switch lever 260 is pivoted on the hinge axis 260*a* downwardly.

Accordingly, a second operational portion 242*b* of the second switch 242 is pushed indirectly by the second key switch portion 237*b* via the switch lever 260. Therefore, the power supply is connected with the driving circuit, and the user can operate the microwave oven.

In the event that the door 230 is incompletely closed and any operational portion of the first, second, and third switches 241, 242, and 243 is not pushed, the power supply is not connected with the driving circuit, and accordingly, the microwave oven is not operated.

As described above, in the safety device for a microwave oven according to the present invention, the third switches 143 and 243, which are arranged in the most inner position of the device chamber 10*b*, are operated directly by the second key switch portions 137*b* and 237*b* of the door keys 137 and 237, respectively.

Accordingly, the switch lever 44 of the conventional safety device of the microwave oven is no longer required between the key switch portions 137*b* and 237*b* and the third switches 143 and 243, so that the lengths L' and L" of the door latches 112 and 212 are shortened, respectively. Since the lengths L' and L" of the door latch 14 are shortened, the total available space in the device chamber 10*b* is enlarged, and the assembly space for the other electric component parts is enlarged. Also, the assembly of the microwave oven improves.

Further, in the safety device for the microwave oven according to the present invention, the wiring pins 141*a*, 142*a*, 143*a*, 241*a*, 242*a*, and 243*a* of the first, second, and third switches 141, 142, 143, 241, 242, and 243 are at least extended along the vertical line of the door keys 137 and 237, or extended inward the device chamber 10*b* from the vertical line of the door keys 137 and 237.

Accordingly, since the wiring pins 141*a*, 142*a*, 143*a*, 241*a*, 242*a*, and 243*a* of the first, second, and third switches 141, 142, 143, 241, 242, and 243 are extended substantially in the same direction, the wiring process and structure are much more simplified, and the assembly of the microwave oven is much improved.

Further, in the safety device for the microwave oven according to the first preferred embodiment of the present invention, the operational portions 142*b* and 143*b* of the second and third switches 142 and 143 are pushed by the second key switch portion 137*b*, simultaneously.

Accordingly, additional parts which were required in the safety device for the subject conventional microwave oven such as the switch lever 44, etc. are no longer required, so that the structure of the safety device is simplified, and due to the reduced number of parts, the assembly of the microwave oven is vastly improved and the manufacturing cost is significantly reduced.

As stated above, preferred embodiments of the present invention are shown and described. Although the preferred embodiments of the present invention have been described, it is understood that the present invention should not be limited to this preferred embodiments but various changes and modifications can be made by one skilled in the art within the spirit and scope of the present invention as hereinafter claimed.

What is claimed is:

1. A safety device for a microwave oven including a cabinet having a cooking chamber and a device chamber, a power supply, a driving circuit, and a door coupled to said cabinet to open and close said cooking chamber, comprising:

a door key movably mounted on said door, having a first key switch portion protruding toward a front side of said cabinet and inserted into said device chamber through said front side when said door closes said cooking chamber;

said first key switch portion having a main body and a distal end extended from said main body, said distal end having an end surface and two opposite side surfaces spaced-apart from each other by a predetermined length of said end surface; and a plurality of switches turned on/off in accordance with said distal end of said first key switch portion to selectively connect said power supply to said driving circuit, said switches disposed within said device chamber to be spaced-apart from each other by said length and disposed to contact respective opposite side surfaces of said distal end of said first key switch portion when said distal end is inserted between said switches.

2. The safety device of claim 1, said door key comprising a second key switch portion spaced-apart from said first key switch portion, said second switch portion having a second distal end.

3. The safety device of claim 2, said second key switch portion inserted into said device chamber to contact a second switch when said door closes said cooking chamber.

4. The safety device of claim 3, said second switch having an operational portion operated by said second key switch portion.

5. The safety device of claim 4, said second switch having a wiring pin extended from said switches and coupled to one of said power supply and said driving circuit, said wiring pin of said switches being inclined with respect to a horizontal line perpendicular to said front side of said cabinet.

6. The safety device of claim 1, said switches comprising an operational portion protruding from a switching surface of said switches facing each other and being contact with respective opposite side surfaces of said distal end.

7. The safety device of claim 1, said switches having a wiring pin extended from a rear surface of said switches opposite to a front surface of said switch adjacent to said door and said front side of said cabinet, said wiring pin coupled to one of said power supply and said driving circuit, each wiring pin of said switches inclined with respect to a horizontal line perpendicular to said front side of said cabinet.

8. The safety device of claim 1, said main body of said key switch portion being inclined and having a first angle with respect to a horizontal line perpendicular to said front side of said cabinet when said door is opened.

9. The safety device of claim 8, said distal end having a second angle with respect to said main body and having a third angle with respect to said front side of said cabinet.

10. The safety device of claim 8, further comprising a guide formed on said device chamber, said guide disposed between said front side of said cabinet and said switches, said guide being inclined and having said first angle with respect to said horizontal line.

11. The safety device of claim 1, said switches each having a longitudinal axis inclined with respect to a horizontal line perpendicular to said front side of said cabinet.

12. The safety device of claim 1, said switches each having a main surface facing each other, each said main surface of said switches inclined with respective to a horizontal line perpendicular to said front side of said cabinet.

13. The safety device of claim 12, said switches each comprising an operational portion protruding from said main surface facing each other, each operational portion disposed to contact respective opposite side surface of said distal end of said key switch portion.

14. The safety device of claim 13, wherein said main surfaces of said switches are not parallel to each other.

15. The safety device of claim 13, wherein said main surfaces of said switches are not perpendicular to each other.

16. The safety device of claim 13, wherein said main surfaces of said switches are not parallel to a horizontal line perpendicular to said front side of said cabinet.

17. A safety device for a microwave oven including a door, a cabinet having a cooking chamber and a device chamber, a power supply, and a driving circuit, comprising:

a door key movably mounted on said door of said microwave oven and having a key switch portion protruding toward a front side of said cabinet, said key switch portion having a distal end;

a plurality of switches to be turned on/off in accordance with said key switch portion to selectively connect the power supply with the driving circuit, said distal end of said key switch portion disposed to be inserted between said switches to contact said switches; and wiring pins extended from a rear surface of said switches opposite to a front surface of said switches adjacent to said door and said front side of said cabinet, said wiring pins inclined with respect to a horizontal line of said door and said front side of said cabinet.

* * * * *